United States Patent [19]

Laing et al.

[11] Patent Number: 4,869,314

[45] Date of Patent: Sep. 26, 1989

[54] HEAT EXCHANGER WITH SECONDARY AND TERTIARY HEAT EXCHANGE SURFACE

[76] Inventors: Oliver P. Laing; Karsten A. Laing, both of 3970 Honeycutt St., San Diego, Calif. 92109; Birger J. Laing, Reutestrasse 5, 78 Freiburg, Fed. Rep. of Germany; Doerte A. Laing, Hofenerweg 37, 7148 Remseck-2, Fed. Rep. of Germany

[21] Appl. No.: 912,357

[22] Filed: Sep. 26, 1986

[30] Foreign Application Priority Data

Sep. 26, 1985 [DE] Fed. Rep. of Germany ..... 3534304
Jun. 25, 1986 [DE] Fed. Rep. of Germany ..... 3621208

[51] Int. Cl.[4] ..... F24H 3/02

[52] U.S. Cl. ..... 165/120; 62/238.6; 165/110

[58] Field of Search ..... 165/146, 156, 110, 40, 165/120; 62/238.6

[56] References Cited

U.S. PATENT DOCUMENTS

| | | | |
|---|---|---|---|
| 1,946,467 | 2/1934 | Bergholm et al. | 165/111 X |
| 2,445,115 | 7/1948 | Hanrahan | 165/156 X |
| 3,067,592 | 12/1962 | McFarlan | 165/146 X |
| 4,114,686 | 9/1978 | Mueller et al. | 165/110 |
| 4,168,745 | 9/1979 | Lastinger | 62/238.6 X |
| 4,474,018 | 10/1984 | Teagan | 62/238.6 X |
| 4,480,172 | 10/1984 | Ciciliot et al. | 165/156 X |
| 4,492,092 | 1/1985 | Smorol et al. | 62/238.6 X |
| 4,549,606 | 10/1985 | Sato et al. | 165/79 |

FOREIGN PATENT DOCUMENTS

| | | | |
|---|---|---|---|
| 1096389 | 3/1957 | Fed. Rep. of Germany | 165/156 |
| 37489 | 4/1981 | Japan | 165/156 |

*Primary Examiner*—Ira S. Lazarus
*Assistant Examiner*—Peggy Neils

[57] ABSTRACT

The heat exchanger, gas to fluid, consists of a cylindrical wall separating fluid from gas and a helical strip forming secondary exchange surfaces which carry additional heat exchange members forming tertiary heat exchange surfaces to increase the active surface and the heat transfer coefficient in the gas compartment.

4 Claims, 3 Drawing Sheets

HEAT EXCHANGER WITH SECONDARY AND TERTIARY HEAT EXCHANGE SURFACE

BACKGROUND OF THE INVENTION

Heat exchangers between liquids and gases are characterized by primary surfaces on the liqud side, and in addition secondary surfaces of the gas side. The predominant configuration is the finned heat exchanger tube type. It is possible with these, to increase the surface on that side of the heat-permeable wall where the gas is conveyed up to 10 times the surface on the wet side of said wall. The heat transfer coefficient of gas is 50 to 100 times smaller than the heat transfer coefficient on the wet side. Therefore, the surface ratio obtainable by finned heat exchanger tubes is much smaller than necessary for optimum heat transfer, resulting in large heat exchanger sizes.

SUMMARY OF THE INVENTION

The invention refers to heat exchangers which carry in addition to secondary surfaces also tertiary heat exchanger surfaces whereby these surfaces should have in addition a higher specific heat transfer than flat surfaces. The preferred configuration is pins added to the fin. Alternatively to pins, the invention uses helices of wire from highly conductive material such as copper. The path of the gas flux should be a helical channel, resulting in a high relative velocity of the gas conveyed. The invention makes use of the favorable heat exchange behavior of thin wires or pins which are oriented generally perpendicular to the gas flux. The invention refers also to configurations of the helical fin consisting of a number of single windings which can be produced by stamping, deep-drawing and embossing processes. In addition, the invention refers to heat exchanger configurations combined with a pump for the liquid conveyed which can be used as desuperheater or condenser for cooling systems.

DESCRIPTION OF THE PREFERRED EMBODIMENTS

Figure 1:
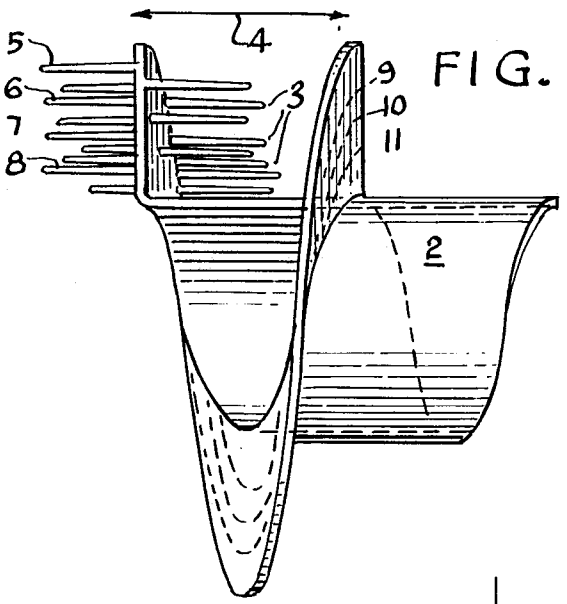
FIG. 1—shows a fin winding whereby the radial extending part forms the secondary heat exchange surface, and the pins form the tertiary heat exchange surfaces.

FIG. 1—shows one helical fin (1) made of wound strip with a hub portion 2. The pins 3 are tapering and their length is less than half the pitch 4. On the left side are four rows 5,6,7,8, on the right side are three rows uniformly distributed over the lines 9,10,11.

Figure 2:
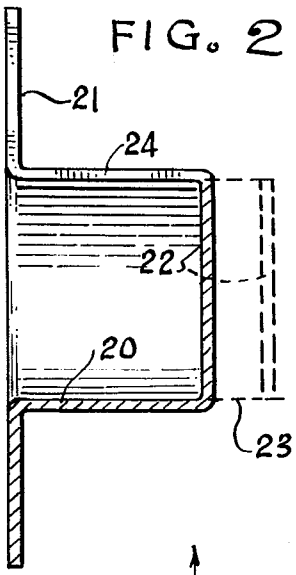
FIG. 2—shows the precurser of sheet metal with high thermal conductivity.

FIG. 2—shows the cap 20 with flange 21 and bottom 22. The metal should have a good thermal conductivity and, in addition, a high ductility. Preferred metals are copper, aluminum, zinc, and tin. In the first step of the operation, the bottom 22 will be stamped out along the dotted lines 23. In a second operation, the ring-shaped precurser will be split along the crossed face 24. In a third operation step, it will be bent into one winding with the pitch 4. In the last step of the operation, this helically shaped winding will be embossed so that the pins 3, 5, 6, 7, 8 are formed by cold extrusion. This unit will be referred to as a "heat-exchanger module".

Figure 3:
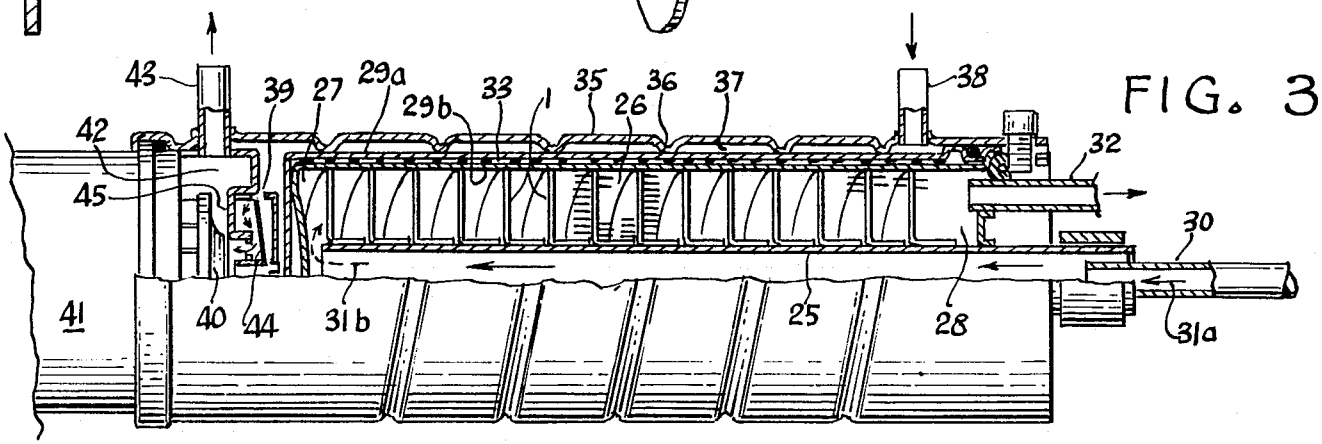
FIG. 3—shows a desuperheater with a fin tube consisting of staggered windings.

FIG. 3—shows a heat exchanger unit designed to serve as a desuperheater for a refrigerator or airconditioning system. The inner tube 25 is part of a finned tube carrying a number of heat exchanger modules as shown in FIG. 1. Between adjacent fins 1 a helical channel 26 will be formed, extending from the first end portion 27 to the second end portion 28. This finned tube 1, 25) is enclosed by a hollow cylinder 29. To provide good thermal conductivity, the periphery of each heat exchanger module is soldered to the inner surface of the cylinder 29. The pipe 30 is connected to the pressure pipe of the compressor. The superheated compressed gas follows the arrows 31*a* and 31*b* and spirals thereafter through the helical channel 26, dissipating the heat to water conveyed in counterflow. After the (freon) gas has been cooled down, it leaves the end portion 28 through pipe 32. A second cylinder 29*a* surrounds the cylinder 29. Grooves 33 between the cylinder 29 and the cylinder 29*a* run in a helix to a conduct connecting the grooves 33 to ambient air, venting the space between the cylinder 29 and the cylinder 29*a*. Around this unit is a jacket 35 which has a helical guide groove 36 that forms a water channel 37 extending from the inlet nipple 38 to the suction side of the pump 41 with impeller 40. The pressure side 42 is connected with the outlet nipple 43. On the inlet side of the pump 41, a bi-metal disk 44 reduces the cross sections of holes 39 arranged around the periphery of the compartment 45 until the water temperature has reached a pre-determined value. Said bi-metal disk 44 opens the holes 39 as soon as the water temperature exceeds said value. The inlet nipple 38 and the outlet nipple 43 are connected by hoses to the lowest and the highest level of a hot water tank so that the tangible heat produced from the superheated (freon) gas can be utilized to produce hot water.

Figure 4:
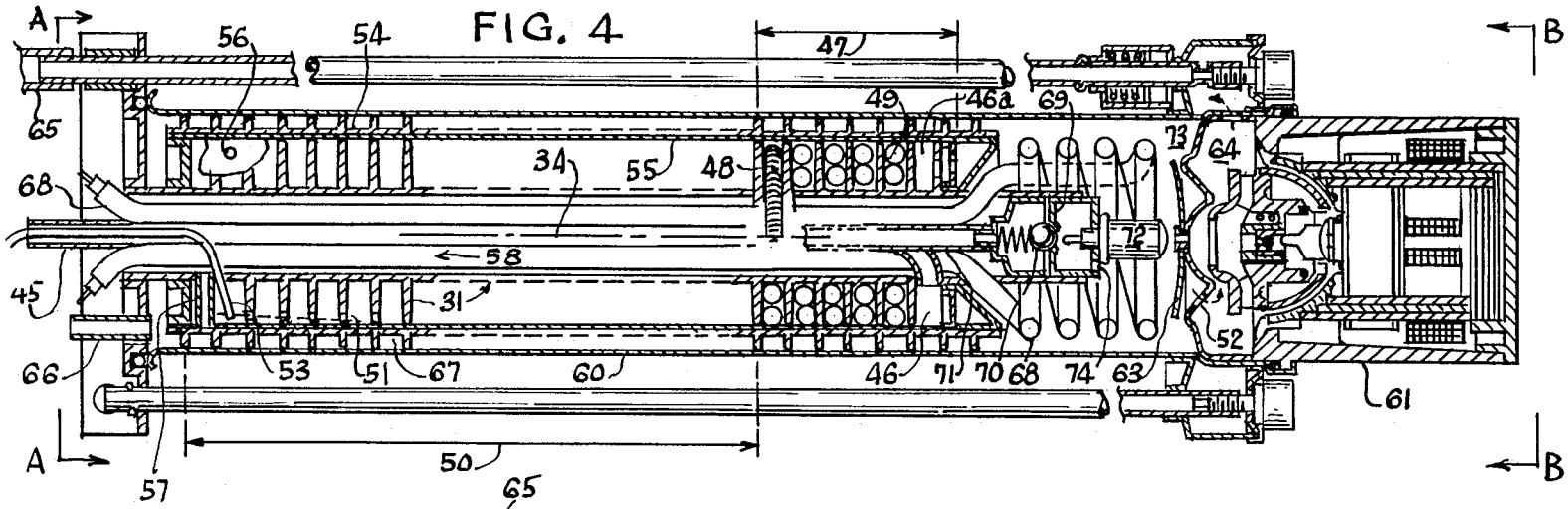
FIG. 4—shows a desuperheater-condenser unit.

FIG. 4—shows a similar design whereby (freon) gas enters the pipe 45 and flows thereafter into the entrance 46 of the helical channel 46*a* between the fins of the finned tube 31. In the first section 47 of the heat exchanger two layers of helically wound wires 48 increase the surface areas, acting as tertiary heat exchange members. To increase the conductivity between these wires and the fins 49, the helical wires 48 are soldered to fins 49. In this first section 47, the temperature of the gas decreases down to condensation temperature. The condensation takes place in the remaining section 50. Preferably the geometrical axis 34 of the unit should run along a slight slope with the motor on the high side. Each fin has a small hole on the lowest point so that the condensate 51 can flow to the entrance of the capillary tube 53. From there the condensate leaves the heat exchanger unit by capillary 53, leading to the evaporator. The wall surrounding the finned tube 31 consists of the cylinder 54 and a liner 55 whereby channels 56 vent through tube 57, then through the inner channel 58 of the finned tube 31 to the ambient air. The outer housing consists of the cylinder 60 and the pump 61. The suction side of the pump has holes 52 and a bi-metal disk 63 which controls the water flow at a pre-determined temperature. The pressure side 64 is connected via a hose 65 with the highest point of a hot water tank while the lowest point of the hot water tank is connected to the inlet nipple 66. The water spirals through the channels 67 and runs counter to the flow of the gas (freon). A tubular electric heater 68 is provided as an auxiliary heating device. A valve plate 69 and a ball 70 are connected to a cold water inlet pipe 71. If the hot water tank is full of hot water, the thermostat 72 opens the cold water line 71 and cold water enters the water compartment 73 through holes 74, providing the necessary cooling for the condensing of the (freon) gas, and leaves the system, carrying away the heat through pipe 89 (shown in FIGS. 5 and 6).

Figure 5B:
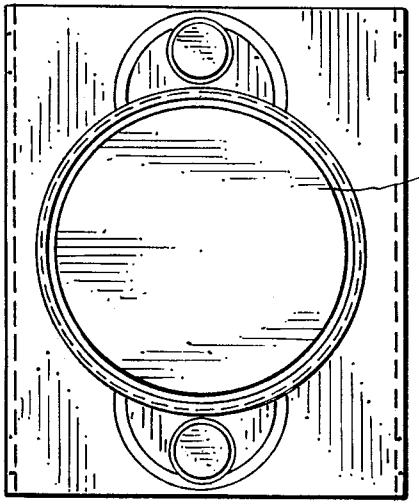
FIG. 5*b*—shows a view on the other axial end.
Figure 5A:
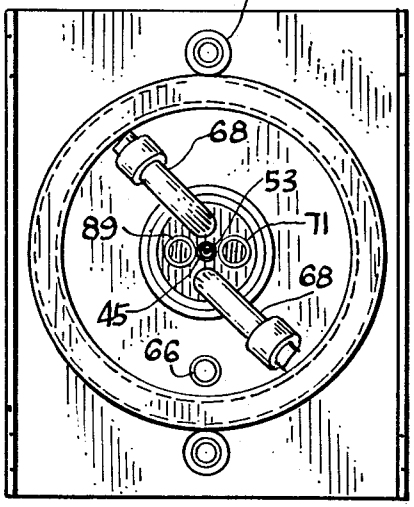
FIG. 5*a*—shows a view on one axial end.

FIG. 5*a*—shows the unit of FIG. 4 from view A.

FIG. 5*b*—shows the same unit from view B.

Figure 6A:
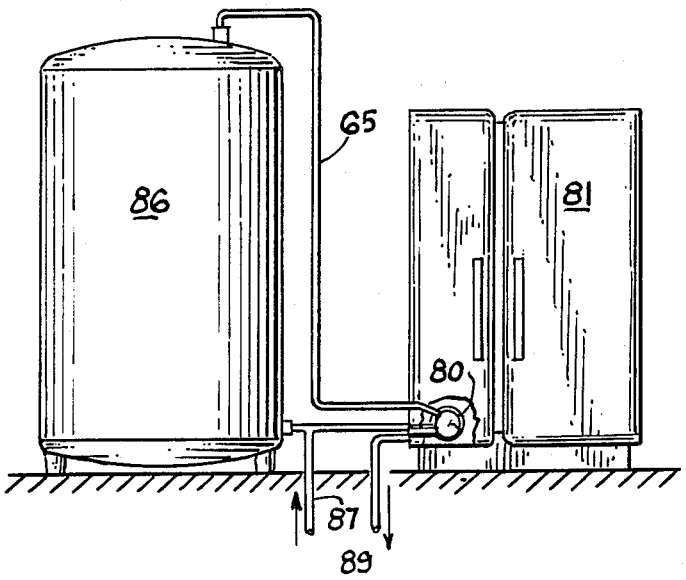
FIG. 6*a* shows a side view of the circuit diagram of a refrigerator utilizing the latent heat to produce hot water.
Figure 6B:
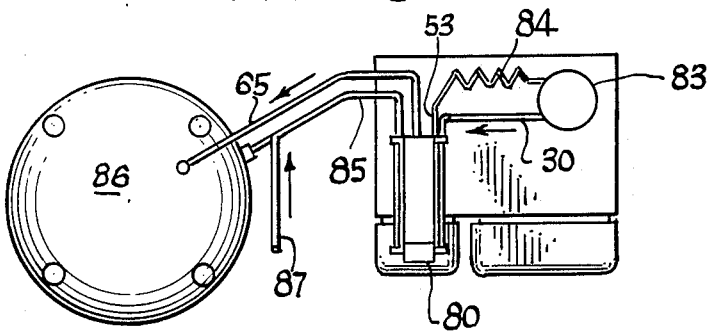
FIG. 6*b* shows a top view of a circuit diagram of a refrigerator utilizing the latent heat to produce hot water.

FIG. 6—shows a diagram with a side and top view. The condensor unit 80, as shown in FIG. 4, is mounted in the lowest compartment of the refrigerator 81. The pressure pipe 30 of the compressor 83 is connected to the pipe 71 as shown in FIG. 4. The capillary tube 53 (as seen in FIG. 4) conveys the condensate to the evaporator 84. The pipe 85 is connected with the bottom region of the hot water tank 86 and connected to the cold water supply pipe 87. The hose 65 is connected to the highest point of the tank 86. Overflowing water can leave the system through pipe 89 (shown in FIG. 5*a*).

What is claimed:

1. An electrical circular pump for the conveyance of the water to be stored in a hot water tank with a motor (41,60) having an axis of rotation and an elongated tubular pump housing (35,60) concentrically aligned to said axis of rotation with a pressure compartment (42,64) which contains an impeller (40) and an outlet port (43,65), said compartment being connected with a suction compartment of said pump housing through an inlet aperture adjacent to the inlet eye of said impeller (40), said suction compartment (73) having a lid at its axial end, said lid forming a unit with a pressure resistant cylinder situated inside said suction compartment and coaxially aligned with said axis of rotation comprising a cylindrical outer wall portion made from an inner metallic liner (29,55) and a metallic shell (29*a*, 54) enclosing a channel (33,56) of very small cross section to leave sufficient metallic contact between liner and shell, an aperture (57) through which said channel (33,56) communicates with ambient air, a tube (25) with a helical fin (1,31) which has good thermal contact with said inner liner (29,55) and forms together with said inner liner a channel (51), its first end communicating with an outlet pipe (32,53) and its second end communicating with an inlet pipe (30,45) which is connected with a pipe (30) of a compressor (83), the cylindrical portion of the metallic shell (29*a*, 54) forming an annular channel together with said suction compartment (73) which channel exhibits near to said lid an inlet port (38,66) and communicates with said inlet aperture, guiding the water conveyed, the pump (41,39,35, or 60,61) exhibiting a seal between the suction compartment (42,64) and said lid and being retractably mounted, permitting access to the outer surface of the pressure resistant cylinder for cleaning and decalcination purposes.

2. An electrical circulator pump as per claim 1 its ring shaped wall having inlet openings (39,52) and orifices directed towards the pump impeller (40) and a bimetal disc (44,63) whose circumference reduces the flow areas of the openings (39,52) with decreasing water temperature.

3. An electrical circulator pump as per claim 1 characterized by a resistant water heater (68) acting as auxiliary heat source for the circuit of potable water.

4. An electrical circulator pump as per claim 1 having a thermostatic actuator (72) which opens a valve (69,70) at a predetermined temperature allowing fresh water to cool the elongated hollow body.

* * * * *